US007675508B2

(12) United States Patent
Imai et al.

(10) Patent No.: US 7,675,508 B2
(45) Date of Patent: Mar. 9, 2010

(54) LIQUID CRYSTAL DISPLAY APPARATUS

(75) Inventors: Takayuki Imai, Fukaya (JP); Takashi Nakamura, Saitama (JP); Miyuki Ishikawa, Kumagaya (JP); Hideaki Mori, Kumagaya (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 794 days.

(21) Appl. No.: 11/463,509

(22) Filed: Aug. 9, 2006

(65) Prior Publication Data

US 2007/0070007 A1 Mar. 29, 2007

(30) Foreign Application Priority Data

Sep. 29, 2005 (JP) ..... 2005-285253
Jul. 4, 2006 (JP) ..... 2006-184406

(51) Int. Cl.
*G09G 3/36* (2006.01)

(52) U.S. Cl. ..... 345/175; 345/104

(58) Field of Classification Search ..... 345/173, 345/175, 104, 690, 102, 89; 349/62
See application file for complete search history.

(56) References Cited

U.S. PATENT DOCUMENTS 4,707,689 A * 11/1987 DiPiazza et al. ..... 345/175
5,105,186 A * 4/1992 May ..... 345/175
2004/0041794 A1* 3/2004 Kidode et al. ..... 345/173
2004/0130532 A1* 7/2004 Gordon et al. ..... 345/166
2005/0093851 A1 5/2005 Nakamura et al.
2005/0134751 A1* 6/2005 Abileah et al. ..... 349/42
2006/0170658 A1* 8/2006 Nakamura et al. ..... 345/173

FOREIGN PATENT DOCUMENTS

EP 1 122 792 A2 8/2001
JP 2003-37852 2/2003
JP 2004-93894 3/2004
KP 2001-0083153 8/2001

* cited by examiner

*Primary Examiner*—Chanh Nguyen
*Assistant Examiner*—Jonathan Blancha
(74) *Attorney, Agent, or Firm*—Oblon, Spivak, McClelland, Maier & Neustadt, L.L.P.

(57) ABSTRACT

In order to prevent reduction in performance due to variations in illuminance of external light, a liquid crystal display unit includes: a pixel section including pixels arranged at each of intersections where a plurality of scanning lines and a plurality of signal lines intersect, and optical sensor circuits provided to at least part of the pixels; an imaging section which generates a multi-gradation image based on detection results of the optical sensor circuits; and a gradient value calculation section which calculates a gradient value which is a ratio of a variation in a gradation tendency value of the multi-gradation image to a variation in sensitivity of the optical sensor circuits.

14 Claims, 12 Drawing Sheets

LIQUID CRYSTAL DISPLAY APPARATUS

CROSS-REFERENCE TO RELATED APPLICATIONS

This application is based upon and claims the benefit of priority from Japanese Patent Application No. 2005-285253 filed Sep. 29, 2005 and No. 2006-184406 filed Jul. 4, 2006; the entire contents of which are incorporated herein by reference.

BACKGROUND OF THE INVENTION

1. Field of the Invention

The present invention relates to a liquid crystal display apparatus in which reduction in performance due to illuminance of external light can be prevented.

2. Description of the Related Art

As a liquid crystal display apparatus which includes an optical sensor circuit in each pixel of a liquid crystal panel and which recognizes a recognition object on a pixel section based on detection results of the optical sensor circuits, an example is described in Japanese Patent Laid-Open Publication No. 2004-93894.

In this liquid crystal display apparatus, when illuminance of external light changes, for example, a recognition rate is sometimes reduced. Specifically, even if the sensitivity of the optical sensor circuits is set so that the recognition rate is high when the illuminance is low, the recognition rate is reduced in some cases when the illuminance is high.

In a liquid crystal display apparatus including a backlight on the back of the liquid crystal panel, when the illuminance is low, the recognition rate is sometimes reduced when the backlight has high luminance. In addition, the high luminance of the backlight increases power consumption thereof.

SUMMARY OF THE INVENTION

An object of the present invention is to provide a liquid crystal display apparatus in which reduction in performance due to variations in illuminance of external light is prevented.

A liquid crystal display apparatus according to the first aspect of the present invention includes: a pixel section including pixels arranged at each of intersections where a plurality of scanning lines and a plurality of signal lines intersect, and optical sensor circuits provided to at least part of the pixels; an imaging section which generates a multi-gradation image based on detection results of the optical sensor circuits; and a gradient value calculation section which calculates a value which is a ratio of a variation in a gradation tendency value of the multi-gradation image to a variation in sensitivity of the optical sensor circuits.

A liquid crystal display apparatus according to the second aspect of the present invention includes: a pixel section including pixels arranged at each of intersections where a plurality of scanning lines and a plurality of signal lines intersect, and optical sensor circuits provided to at least part of the pixels; an imaging section which generates a multi-gradation image based on detection results of the optical sensor circuits; a recognition section which recognizes a recognition object on the pixel section based on the multi-gradation image; a gradient value calculation section which calculates a gradient value which is a ratio of a variation in a gradation tendency value of the multi-gradation image to a variation in sensitivity of the optical sensor circuits; a gradation tendency value calculation section which, based on the gradient value, calculates a target gradation tendency value for increasing a recognition rate of the recognition section; and a sensitivity adjustment section which changes the sensitivity of the optical sensor circuits so as to cause the multi-gradation image to have the calculated target gradation tendency value.

A liquid crystal display apparatus according to the third aspect of the present invention includes: a pixel section including pixels arranged at each of intersections where a plurality of scanning lines and a plurality of signal lines intersect, and optical sensor circuits provided to at least part of the pixels; an imaging section which generates a multi-gradation image based on detection results of the optical sensor circuits; a recognition section which recognizes a recognition object on the pixel section based on the multi-gradation image; a gradient value calculation section which calculates a gradient value which is a ratio of a variation in a gradation tendency value of the multi-gradation image to a variation in sensitivity of the optical sensor circuits; a threshold value determination section which determines whether the gradation tendency value is not less than a threshold value when the sensitivity of the optical sensor circuits is caused to be a predetermined sensitivity; a gradation tendency value calculation section which reads a beforehand stored target gradation tendency value when the gradation tendency value is not less than the threshold value, and which calculates, based on the gradient value, a target gradation tendency value for increasing a recognition rate of the recognition section when the gradation tendency value is less than the threshold value; and a sensitivity adjustment section which changes the sensitivity of the optical sensor circuits so as to cause the multi-gradation image to have the read or calculated target gradation tendency value.

DESCRIPTION OF THE EMBODIMENTS

First Embodiment

Hereinafter, a description is given of embodiment of the present invention with reference to the drawings.

Figure 1:
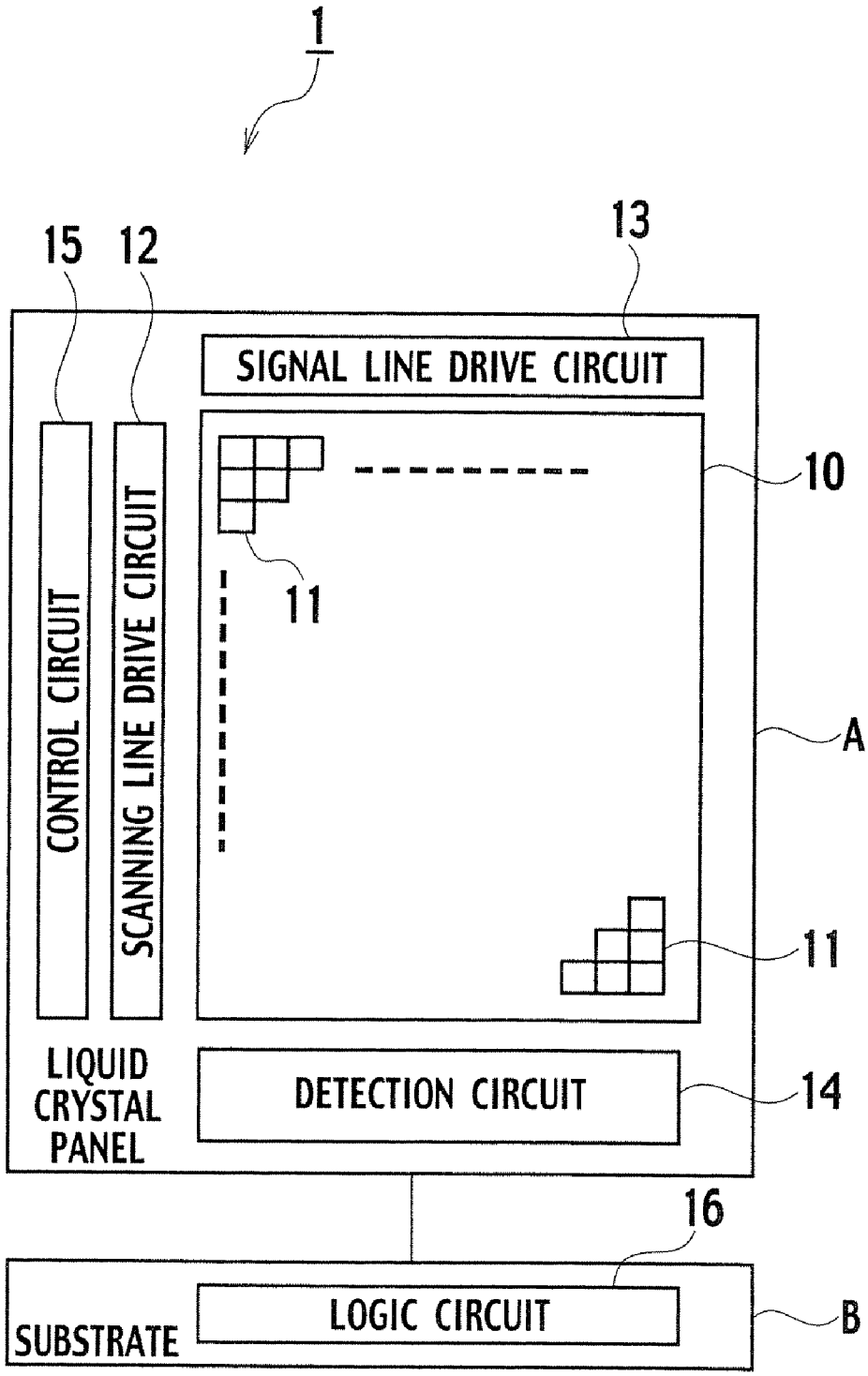
FIG. 1 is a view showing a schematic configuration of a liquid crystal display apparatus in the case of a first embodiment.

FIG. 1 is a view schematically showing a configuration of a liquid crystal display 1 in the case of a first embodiment of the present invention.

A liquid crystal display apparatus 1 is an apparatus which displays an externally given display image and which recognizes a touch of a finger as a recognition object (touch sensing). The liquid crystal display apparatus 1 includes a liquid crystal panel A and a substrate B connected to the liquid crystal panel A through a not-illustrated flexible cable or the like.

The liquid crystal panel A includes an array substrate and an opposed substrate which is opposed to the array substrate with a liquid crystal layer interposed in between. The array substrate is constituted a transparent insulating substrate of glass or the like, on which a plurality of scanning lines and a plurality of signal lines intersect each other, which are not illustrated. The opposed substrate is constituted of a transparent insulating substrate of glass or the like. Each circuit on the liquid crystal panel A is constituted, for example, a polysilicon thin film transistor (TFT). On the back of the liquid crystal panel A, a backlight 17 is provided (See FIG. 3). On the front of the liquid crystal display, a protection plate is sometimes provided.

The liquid crystal panel A includes a pixel section 10 having of pixels 11 formed at each of intersections where the scanning lines and signal lines intersect each other. Each of the pixels 11 includes a display circuit D and an optical sensor circuit S, which are not shown in FIG. 1, and sometimes includes a color filter of any one of red (R), green (G) and blue (B).

The liquid crystal panel A includes a scanning line drive circuit 12 which drives the scanning lines, a signal line drive circuit 13 which supplies picture signals to the signal lines, a detection circuit 14 which detects signals from the optical sensor circuits S, and a control circuit 15 which controls the optical sensor circuits S.

The substrate B includes a logic circuit 16 which gives the display image to the signal line drive circuit 13 and which controls the control circuit 15 based on data from the detection circuit 14.

Figure 2:
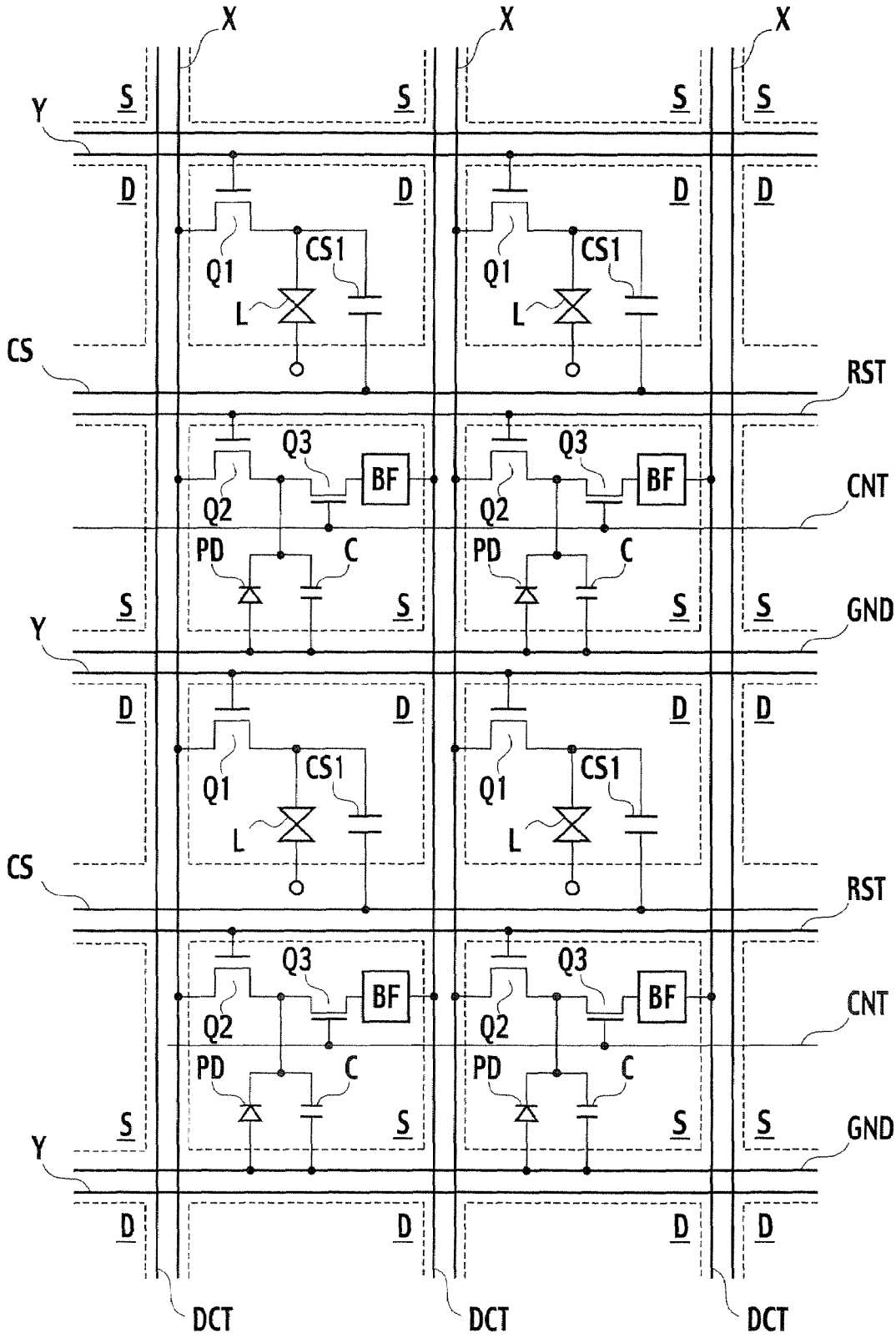
FIG. 2 is a view showing a part of a pixel section in detail.

FIG. 2 is a view showing a part of the pixel section 10 in detail.

The pixels 11 include the display circuits D and the optical sensor circuits S.

First, the display circuits D are described.

Each of the display circuits D includes: a pixel transistor Q1 which is a thin film transistor connected to appropriate one of the signal lines X and appropriate one of the scanning lines Y; a transparent pixel electrode P to which the picture signal is written when the pixel transistor Q1 is turned on; a liquid crystal capacity L; and a storage capacitor CS1. The liquid crystal capacity L is structured by interposing the liquid crystal display layer between the pixel electrode P and a transparent counter electrode provided in the opposed substrate. The storage capacity CS1 includes the pixel electrode P and appropriate one of storage capacity lines CS parallel to the scanning lines Y.

Incidentally, the pixel transistors Q1 in the respective display circuits D, which are aligned in the longitudinal direction of each scanning line Y, are connected to the scanning line Y in common. The pixel transistors Q1 in the respective display circuits D, which are aligned in the longitudinal direction of each signal line X, are connected to the signal line X.

Next, the optical sensor circuits S are described.

In the array substrate of the liquid crystal panel A, for the optical sensor circuits S, there are formed reset lines RST and control lines CNT from the control circuit 15, and detection lines DCT to the detection circuit 14.

Each of the optical sensor circuits S includes: a thin film transistor Q2 which is connected to appropriate one of the signal lines X and appropriate one of the reset lines RST; a capacitor C which is charged when the thin film transistor Q2 is turned on; a photoelectric conversion device PD causing the capacitor C to discharge; a thin film transistor Q3 which is connected to appropriate one of the control lines CNT; and a buffer BF. The buffer BF is connected to the capacitor C via the thin film transistor Q3, performs binary determination for inter-electrode voltage of the capacitor C, and outputs the determination result to the detection line DCT. The photoelectric conversion device PD is, for example, a photodiode or a phototransistor.

The control circuit 15 of FIG. 1 is configured to charge each capacitor C until the inter-electrode voltage of the capacitor C reaches precharge voltage corresponding to precharge voltage data which are set by the logic circuit 16. Moreover, the control circuit 15 controls each optical sensor circuit S so that the inter-electrode voltage of the capacitor C is binarized by the buffer BF after exposure time corresponding to exposure time data, which are set by the logic circuit 16, has passed from the start of the discharge by the photoelectric conversion device PD.

Figure 3:
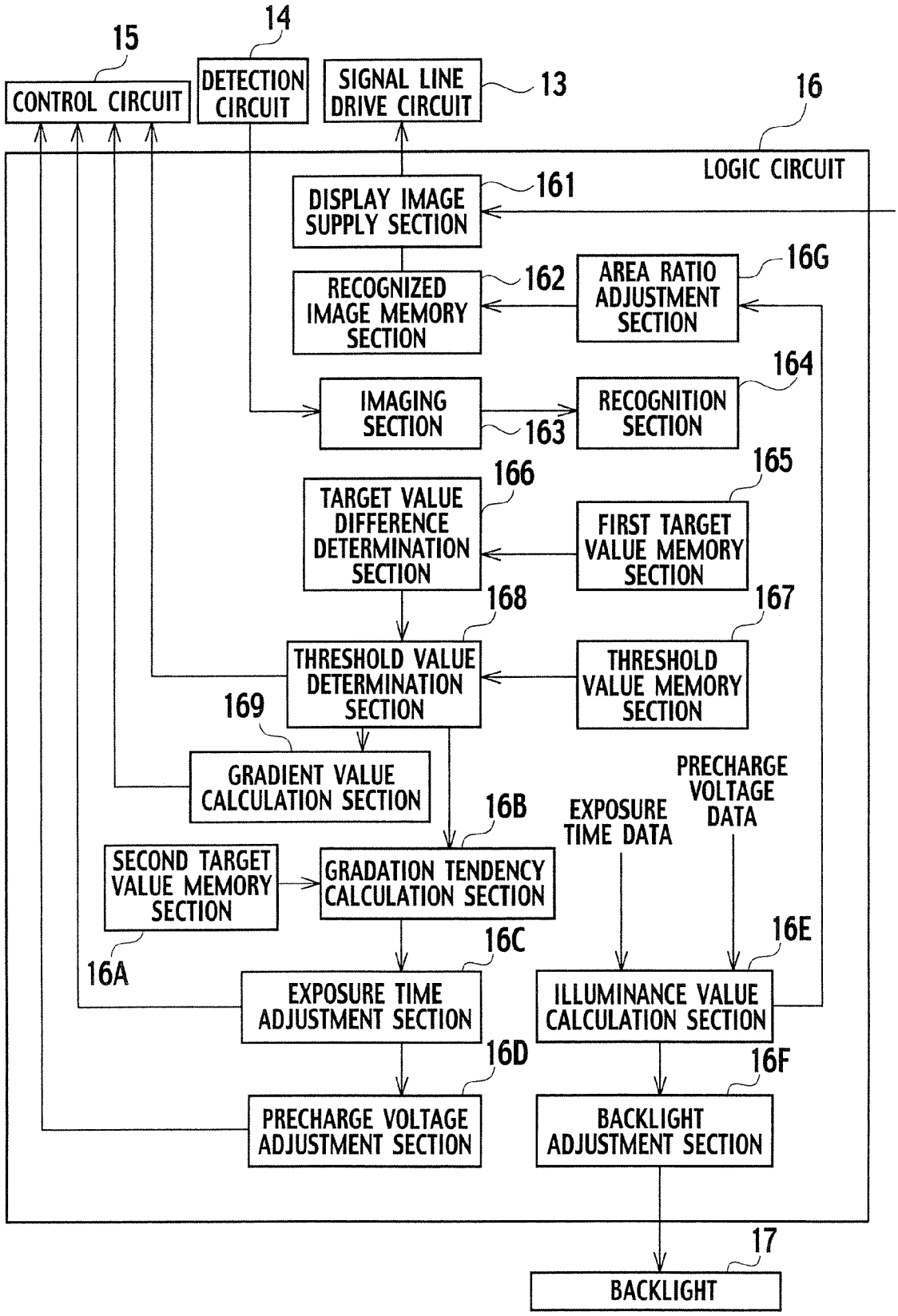
FIG. 3 is a block diagram of a logic circuit.

FIG. 3 is a block diagram showing a configuration of the logic circuit 16.

The logic circuit 16 includes: a display image supply section 161 which supplies an externally given display image to the signal drive circuit 13; and a recognized image memory section 162 storing a recognition time displayed image which is a two-gradation image displayed at the time of the finger sensing.

The recognition time displayed image is a two-gradation image, which has two-gradation values. When the two-gradation value indicates 1 (black), a small amount of light is transmitted. When the two-gradation value indicates 0 (white), a large amount of light is transmitted.

Figure 4A:
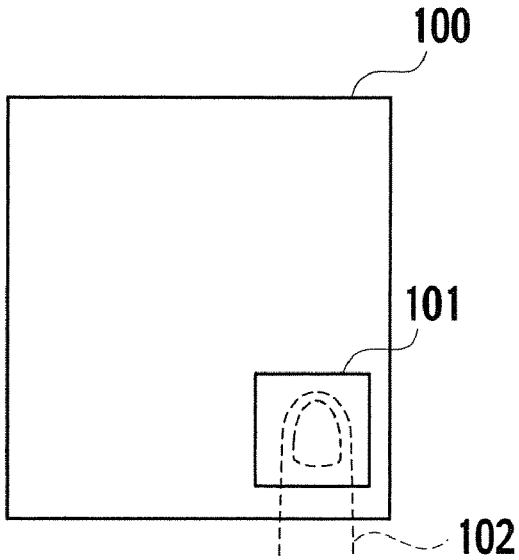
FIG. 4A is a view showing a recognition time displayed image.
Figure 4B:
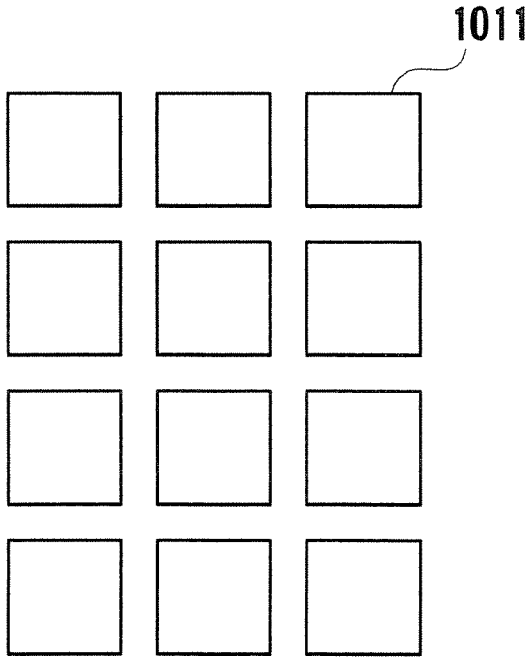
FIG. 4B is a view showing a black and white image of the recognition time displayed image.

FIGS. 4A and 4B are views showing the recognition time displayed image.

The recognized image memory section 162 stores a recognition time displayed image 100 including a black and white image 101 as an index of the finger 102 as shown in FIG. 4A.

Size of the black and white image 101 is determined depending on size of the finger 102. Part of the recognition time displayed image 100 except the black and white image 101 has two-gradation values of 0 (white).

On the other hand, as shown in FIG. 4B, the black and white image 101 includes a plurality of black images 1011 whose two-gradation values are 1 (black), or a black image including a lot of portions whose two-gradation values are 1 (black). These black images 1011 are spaced from one another. The two-gradation values of the other part are 0 (white).

The logic circuit 16 of FIG. 3 includes an imaging section 163 which generates a multi-gradation image based on the data from the detection circuit 14; and a recognition section 164 which recognizes a touch of the finger based on the multi-gradation image.

The multi-gradation image has multi-gradation values each corresponding to each pixel 11. This multi-gradation value is a value which increases as the finger approaches the screen to reduce intensity of light incident on the photoelectric conversion device PD.

The logic circuit 16 includes a first target value memory section 165 for storing a target gradation tendency value which is a target value of the gradation tendency value, which indicates entire gradation tendency of the multi-gradation image. Note that, as the gradation tendency value, it is conceivable to use, for example, an average, a median, a value at the one third from the maximum value, and an integral value, of the multi-gradation values constituting the multi-gradation image.

In addition, the logic circuit 16 includes a target value difference determination section 166, a threshold value memory section 167, and a threshold value determination section 168.

The target value difference determination section 166 calculates the gradation tendency value from the multi-gradation image and then calculates a difference between the calculated gradation tendency value and the target gradation tendency value (gradation tendency value difference). Then the target value difference determination section 166 determines whether the gradation tendency value difference is more than a tolerance. The tolerance is a maximum tolerable value of the gradation tendency value difference. The target value difference determination section 166 stores a tolerance.

The threshold value memory section 167 stores the gradation tendency threshold value which is a threshold value of the gradation tendency value.

The threshold value determination section 168 beforehand stores the precharge voltage data and exposure time data. When the gradation tendency value difference exceeds the tolerance, the threshold value determination section 168 sets the beforehand stored precharge voltage data and exposure time data in the control circuit 15. Then the threshold value determination section 168 calculates the gradation tendency value from the multi-gradation image in the set precharge voltage data and exposure time data. Then the threshold value determination section 168 determines whether the calculated gradation tendency value is not less than the gradation tendency threshold value.

The logic circuit 16 includes a gradient value calculation section 169 and a second target value memory section 16A. When the gradation tendency value is less than the gradation tendency threshold value, the gradient value calculation section 169 calculates a gradient value (dm/dv) which is a ratio of a variation (dm) in the gradation tendency value to a variation (dv) in the precharge voltage while the exposure time data are assumed to be constant.

The second target value memory section 16A stores the target gradation tendency value which is used when the gradation tendency value is not less than the gradation tendency threshold value.

The logic circuit 16 includes a gradation tendency value calculation section 16B. When the gradation tendency value is less than the gradation value threshold value, the gradation tendency value calculation section 16B calculates the target gradation tendency value from the gradient value. When the gradation tendency value is not less than the gradation value threshold value, the gradation tendency value calculation section 16B reads the target gradation tendency value stored in the second target value memory section 16A.

The logic circuit 16 includes: an exposure time adjustment section 16C which changes the exposure time while fixing the precharge voltage; and a precharge voltage adjustment section 16D which changes the precharge voltage while fixing the exposure time.

The exposure time and precharge voltage adjustment sections 16C and 16D constitute a sensitivity adjustment section which changes the sensitivity of the optical sensor circuits S.

The logic circuit 16 includes an illuminance value calculation section 16E, a backlight adjustment section 16F, and an area ratio adjustment section 16G. The illuminance value calculation section 16E calculates an illuminance value reflecting the illuminance of external light based on the exposure time data and precharge voltage data.

The backlight adjustment section 16F stores a threshold value of the illuminance value calculated by the illuminance value calculation section 16E, and changes the luminance of the backlight 17 depending on a result of a comparison between the threshold value of the illuminance value and the illuminance value calculated by the illuminance value calculation section 16E.

The area ratio adjustment section 16G stores a threshold value of the illuminance value, and changes an area ratio in the black and white image of the white to black depending on the result of the comparison between the threshold value of the illuminance value and the illuminance value calculated by the illuminance value calculation section 16E.

Next, a description is given of processes of the liquid crystal display apparatus 1.

[Process to Display an Externally Given Display Image]

First, a description is given of a process carried out to display the externally given display image.

The display image supply section 161 of the logic circuit 16 supplies the externally given display image to the signal line drive circuit 13. Accordingly, during a first horizontal scanning period in a subsequent frame period, the signal line drive circuit 13 causes voltage of the picture signal, which is to be supplied to each signal line X, to be voltage corresponding to the gradation value, for example, at a horizontal position in an uppermost line of the display image. On the other hand, during the horizontal scanning period, the scanning line drive circuit 12 drives the scanning line Y corresponding to the pixels 11 in the uppermost line.

Thus, the pixel transistors Q1 connected to the scanning line Y are turned on, and the picture signal (voltages according to the corresponding gradation values) is written in the pixel electrodes P connected to the pixel transistors Q1. In other words, the liquid crystal capacity L consisting of the respective pixel electrodes P is charged correspondingly to the gradation values. The amounts of light transmitted through the liquid crystal capacity L are thus made corresponding to the gradation values. In other words, the uppermost line of the display image is displayed by the uppermost line of the pixel section 10.

During the subsequent horizontal scanning period, while the display of the uppermost line is being maintained, the second line of the pixel section 10 displays the second line of the display image by means of the similar process. Hereinafter, similar processes are sequentially carried out, and during the last horizontal scanning period in the frame period, the lowermost line of the pixel section 10 displays the lowermost line of the display image. Accordingly, the entire display image is displayed during the frame period.

In addition, the display of the frame period is also carried out in the subsequent frame periods, thereby the display image is continuously displayed.

[Process to Recognize Finger Touch]

Next, a description is given of a process to recognize a finger touch.

The display image supply section 161 of the logic circuit 16 reads the recognition time display image 100 from the recognized image memory section 162, and supplies the recognition time display image 100 to the signal line drive circuit 13. Accordingly, the liquid crystal display apparatus 1 displays the recognition time display image 100 as in the case of the externally given display image.

Furthermore, the liquid crystal display apparatus 1 performs the following process at the time between frame periods.

First, during the first period of this time, the control circuit 15 makes a control to cause the voltage of each signal line X to be precharge voltage corresponding to the precharge voltage data which are set by the logic circuit 16. And the control circuit 15 makes a control to cause the reset line RST and control line CNT corresponding to the pixels 11 of the uppermost line, for example, to conduct high voltage. In each of the pixels 11 of the uppermost line, the capacitor C is charged until the inter-electrode voltage of the capacitor C reaches the precharge voltage corresponding to the precharge voltage data.

Thereafter, the control circuit 15 makes a control to cause the reset line RST and control line CNT, for example, to conduct low voltage. Then, upon receiving external light and light from the backlight 17 being reflected on the finger, the photoelectric conversion device PD begins discharge of the capacitor C.

When the exposure time corresponding to the exposure time data which are set by the logic circuit 16 has passed, the control circuit 15 makes a control to cause the control lines CNT, for example, to conduct high voltage to activate the buffers BF. Accordingly, the buffers BF perform binary determination for the inter-electrode voltage of the respective capacitors C, hold the result of the determination, and then output the result of the determination to the respective detection lines DCT. Then, the detection circuit 14 converts the result of the determination, which is outputted to each detection line DCT, into serial data, and outputs the serial data to the logic circuit 16.

During a subsequent period, by means of a similar process, the detection circuit 14 outputs serial data of the second line to the logic circuit 16. Similar processes are sequentially performed, and during the last period, the detection circuit 14 outputs serial data of the lowermost line to the logic circuit 16. Accordingly, the logic circuit 16 obtains the serial data, that is, a two-gradation image, at the time between frame periods.

In addition, such a process is performed thereafter, thereby the logic circuit 16 sequentially obtains two-gradation images.

In the logic circuit 16, the imaging section 163 converts a predetermined two-gradation image into a multi-gradation image. Here, for example, it is assumed that each two-gradation value, which constitutes a two-gradation image, is replaced with an average of two-gradation values in the vicinity thereof, thereby the multi-gradation image is generated.

When the imaging section 163 subsequently generates a multi-gradation image in a similar manner, the recognition section 164 generates a difference image of these two multi-gradation images, and extracts a peculiar area in the difference image, specifically, edge positions of a touch area which varies when the finger touches the pixel section 10. The recognition section 164 calculates barycentric coordinates of an area surrounded by the edge positions, that is, the touch area. When the barycentric coordinates are within the area of the black and white image 101, the recognition section 164 recognizes that the finger has touched the black and white image 101.

Incidentally, an S/N ratio, which is obtained by dividing a signal value indicating gradation tendency of the finger touch area by a noise value indicating gradation tendency of an area which is not the touch area, is reduced because of a variation in the illuminance of external light, and the recognition rate is accordingly reduced in some cases.

Figure 5B:
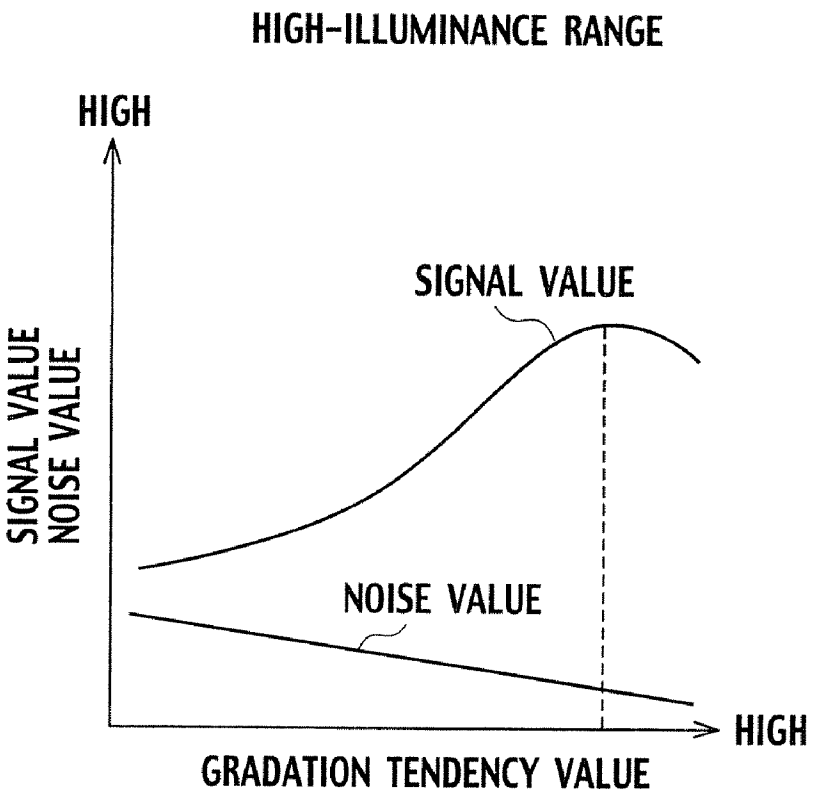
FIG. 5B is a graph showing correlations in a high-illuminance range between the signal value or noise value and the gradation tendency value.
Figure 5A:
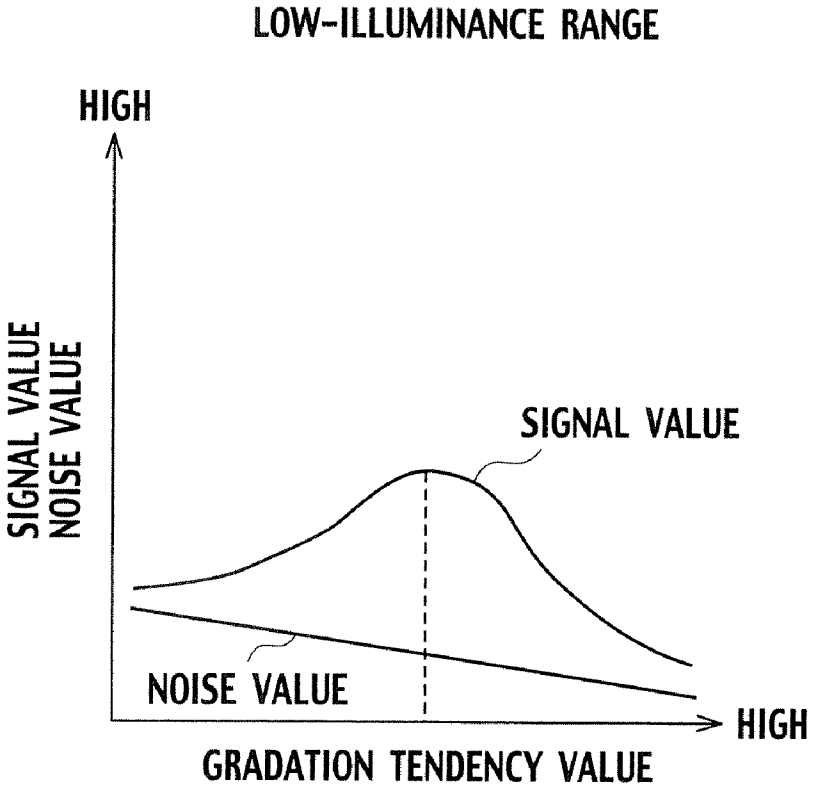
FIG. 5A is a graph showing correlations in a low-illuminance range between a signal value or a noise value and a gradation tendency value.

FIG. 5A is a graph showing correlations between the signal values/noise values and the gradation tendency value when the illuminance of external light is within a low-illuminance range. FIG. 5B is a graph showing correlations between the signal values/noise values and the gradation tendency value when the illuminance of external light is within a high-illuminance range. Specifically, in FIGS. 5A and 5B, while the exposure time and the precharge voltage are constant, the illuminance of external light is not more than 10001 lx in FIG. 5A, and the illuminance of external light is not more than 2001 lx in FIG. 5B.

As shown in FIG. 5A, in the low-illuminance range, the noise value decreases as the gradation tendency increases. On the other hand, the signal value reaches a peak at a gradation tendency value (i.e., the ideal gradation tendency value) when the peak value (a maximum S/N ratio) is obtained, and decreases as the gradation tendency value decreases or increases.

As shown in FIG. 5B, in the high-illuminance range, the signal values and the noise values vary as in the case of the signal values and the noise values in the low-illuminance range. However, the gradation tendency value (i.e., the ideal gradation tendency value) at the time when the peak value of the signal value is obtained is larger than the ideal gradation tendency value in the case of the low-illuminance range.

For example, when the illuminance of external light is within the low-illuminance range, in order to maximize the S/N ratio, the gradation tendency value is adjusted so that the signal value reaches a peak. Thereafter, when the illuminance of external light increases and comes into the high-illuminance range, although the gradation tendency value increases, the S/N ratio decreases if the exposure time and the precharge voltage are constant. In some cases, black saturation may occur. This reduces the recognition rate.

In contrast, when the illuminance of external light is within the high-illuminance range, in order to maximize the S/N ratio, the gradation tendency value is adjusted so that the signal value reaches a peak. Thereafter, when the illuminance of external light decreases and comes into the low-illuminance range, although the gradation tendency value decreases, the S/N ratio decreases if the exposure time and the precharge voltage are constant. In some cases, white saturation may occur. This reduces the recognition rate.

In other words, even if the precharge voltage data and exposure time data are set in the control circuit 15 so as to provide the maximum S/N ratio, the S/N ratio decreases when the illuminance of external light changes from the low-illuminance range to the high-illuminance range, or from the high-illuminance range to the low-illuminance range. This reduces the recognition rate.

Figure 6:
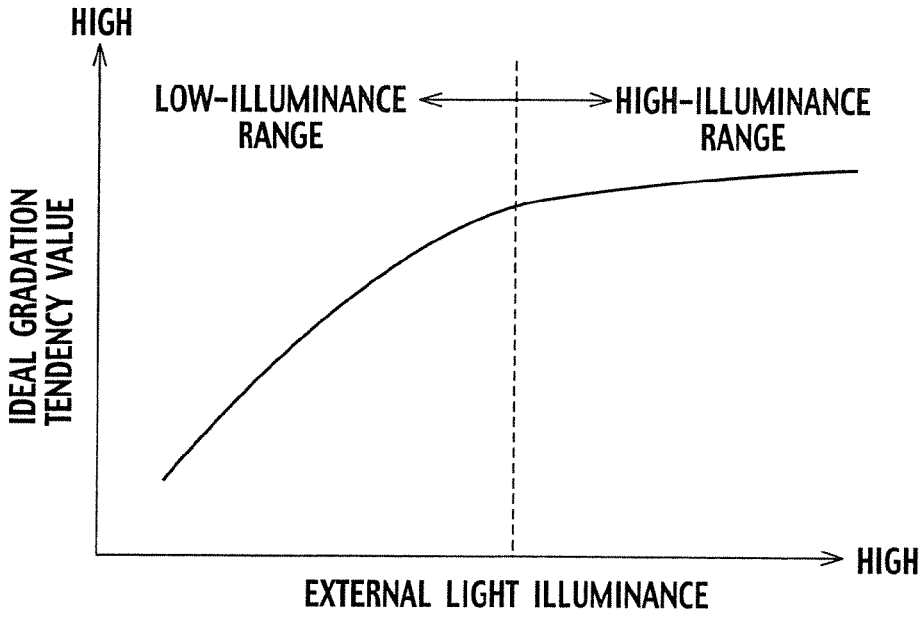
FIG. 6 is a graph showing a correlation between illuminance of external light and an ideal gradation tendency value.

FIG. 6 is a graph showing a correlation between the illuminance of external light and the ideal gradation tendency value.

The ideal gradation tendency value increases as the illuminance of external light increase, but a rate of change in the ideal gradation tendency value is low in the high-illuminance range. Therefore, only in the high-illuminance range, it is possible to obtain a nearly maximum S/N ratio even if the precharge voltage data and exposure time data are not changed.

On the other hand, in the low-illuminance range, the rate of change in the ideal gradation tendency value is high, and the ideal gradation tendency value changes when the illuminance of external light changes. It is therefore impossible to obtain a nearly maximum S/N ratio, and the recognition rate is accordingly reduced. Therefore, an index of the illuminance of external light in the low-illuminance range is required.

Figure 7:
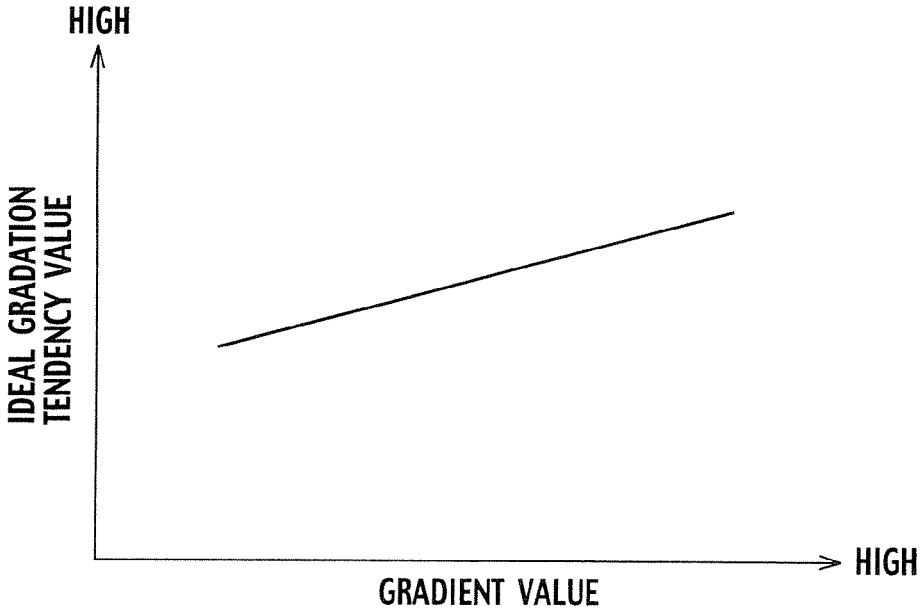
FIG. 7 is a graph showing a correlation between the ideal gradation tendency value and a gradient value.

FIG. 7 is a graph showing a correlation between the ideal gradation tendency value and the gradient value.

The ideal gradation tendency value increases as the gradient value increases. Specifically, the ideal gradation tendency value changes when the gradient value changes, as in the case where the ideal gradation tendency value changes when the illuminance of external light changes in the low-illuminance range. The gradient value is therefore suitable for the index of the illuminance of external light in the low-illuminance range.

From the aforementioned reason, the gradation tendency value calculation section 16B includes the following equation (1), which indicates the relation of FIG. 7, and substitutes the gradient value into the equation (1). The gradation tendency value calculation section 16B then calculates the target gradation tendency value which is the ideal gradation tendency value corresponding to the substituted gradient value.

$$\text{Target gradation tendency value}=(a\times\text{Gradient value})+b \quad (1)$$

where a and b are constants

Figure 8:
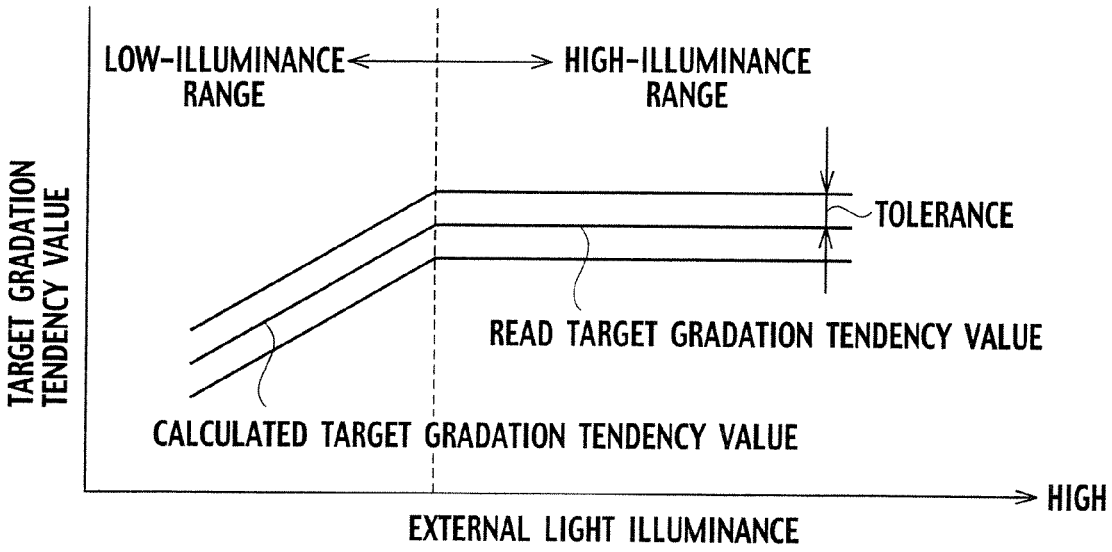
FIG. 8 is a graph showing a relation between a target gradation tendency value and the illuminance of external light.

FIG. 8 is a graph showing a relation between the target gradation tendency value and the illuminance of external light.

In the high-illuminance range, the rate of change in the ideal gradation tendency value is low as described above. In the high-illuminance range, therefore, the target gradation tendency value is set at a constant target gradation tendency value read from the first target value memory section 165, in the case where the gradation tendency value, which is obtained when the precharge voltage data and exposure time data stored by the threshold value determination section 168 are set, is not less than the gradation tendency threshold value. This is for the purpose of preventing the gradation tendency value difference between the target gradation tendency value and the gradation tendency value from exceeding the tolerance.

In the low-illuminance range, as in the case of the high-illuminance range, the gradation tendency value difference is prevented from exceeding the tolerance. In the low-illuminance range, the rate of change in the ideal gradation tendency value is high. Accordingly, in the case where the gradation tendency value, which is obtained when the precharge voltage data and exposure time data stored by the threshold value determination section 168 are set, is less than the gradation tendency threshold value, the target gradation tendency value is changed with the equation (1), which uses the gradient value as the index of the illuminance of external light.

[Calibration-Related Process]

Next, a description is given of a process related to calibration. The calibration here is to prevent the gradation tendency value difference from exceeding the tolerance (i.e., to maintain the gradation tendency value difference not more than the tolerance).

Figure 9:
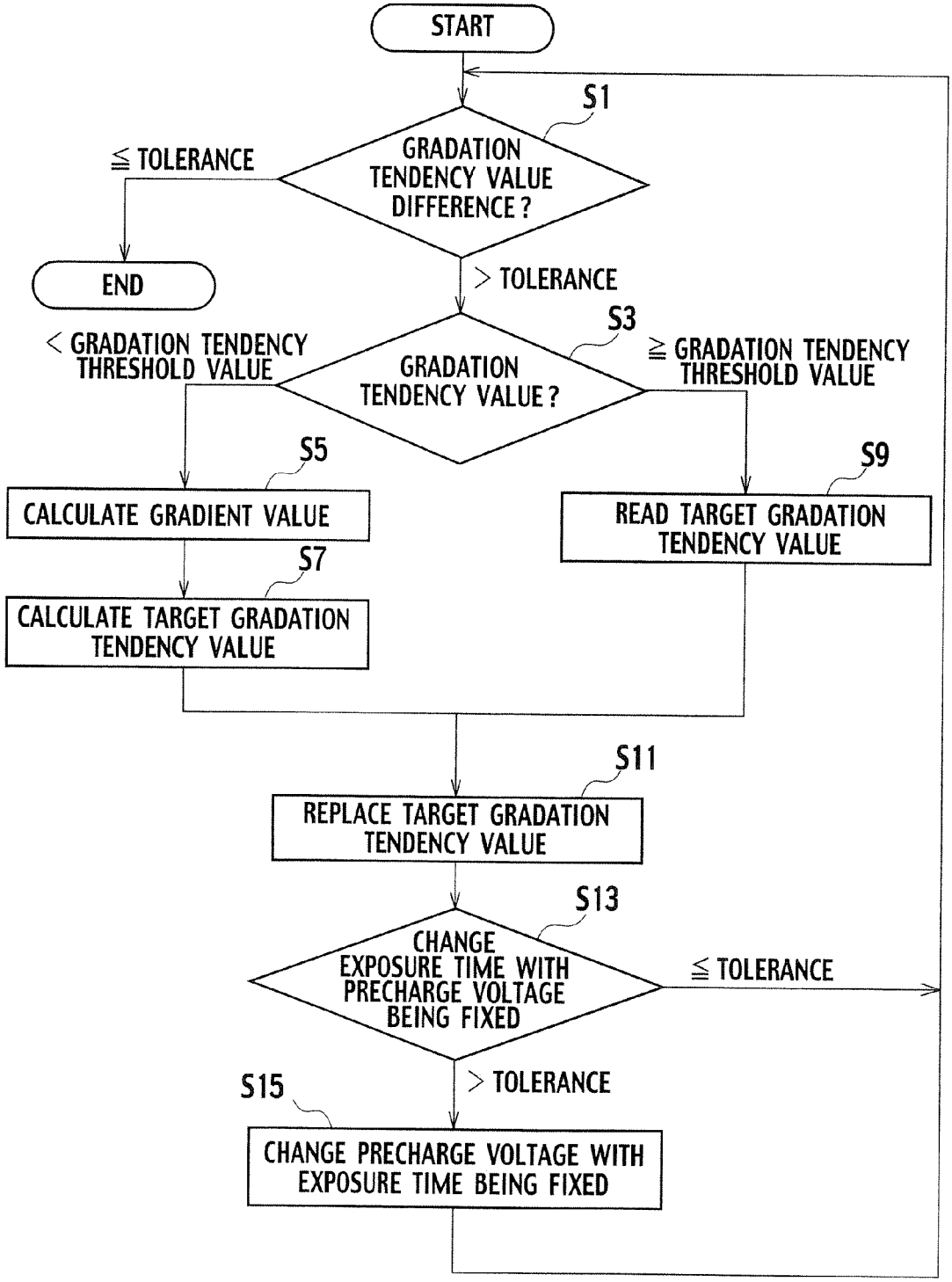
FIG. 9 is a flowchart of a calibration-related process.

FIG. 9 is a flowchart related to the calibration.

The target value difference determination section 166 reads the target gradation tendency value from the first target value memory section 165, for example, at a predetermined time or when a predetermined operation is performed. Then the target value difference determination section 166 calculates the gradation tendency value based on the multi-gradation image obtained from the imaging section 163. Then the target value difference determination section 166 calculates the gradation tendency value difference between the calculated gradation tendency value and the target gradation tendency value, and determines whether the gradation tendency value difference is more than the tolerance beforehand stored (Step S1).

When the gradation tendency value difference is not more than the tolerance, the process is terminated.

When the gradation tendency value difference is more than the tolerance, the threshold value determination section 168 reads the gradation tendency threshold value from the threshold value memory section 167. Then the threshold value determination section 168 sets the beforehand stored precharge voltage data and exposure time data in the control circuit 15, and calculates the gradation tendency value from the multi-gradation image obtained from the precharge voltage data and exposure time data. Then the threshold value determination section 168 determines whether the calculated gradation tendency value is not less than the gradation tendency threshold value (Step S3).

When the calculated gradation tendency value is less than the gradation tendency threshold value, the gradient value calculation section 169 calculates a gradient value, which is a ratio of a variation of the gradation tendency value to a variation of the precharge voltage with the exposure time being fixed (S5).

Here, the gradient value calculation section 169 sets certain exposure time data and precharge voltage data in the control circuit 15, and calculates the gradation tendency value from the multi-gradation image obtained at this time. Moreover, the gradient value calculation section 169 sets the same exposure time data and different precharge voltage data in the control circuit 15, and calculates the gradation tendency value from the multi-gradation image obtained at this time.

Then the gradient value calculation section 169 calculates the difference between these two gradation tendency values, and also calculates a precharge voltage difference between the two precharge voltage data. Then the gradient value calculation section 169 calculates the gradient value by dividing the gradation tendency value difference by the precharge voltage difference.

Next, the gradation tendency value calculation section 16B calculates the target gradation tendency value by using the gradient value (Step S7). Specifically, the gradation tendency value calculation section 16B substitutes the gradient value calculated in Step S5 into the equation (1) to obtain the target gradation tendency value, which is equivalent to the ideal gradation tendency value in FIG. 7 (Step S7).

As described above, in Step S7, the target gradation tendency value corresponding to the gradient value is obtained by the calculation. In this embodiment, a memory section beforehand storing the target gradation tendency value corresponding to each gradient value is therefore unnecessary. Accordingly, in this embodiment, storage capacity can be reduced.

On the other hand, when the calculated gradation tendency value is not less than the gradation tendency value threshold value, the gradation tendency value calculation section 16B reads the target gradation tendency value from the second target value memory section 16A (Step S9). In this case, the calculation of the target gradation tendency value is not required.

After obtaining the target gradation tendency value in Step S7 or S9, the gradation tendency value calculation section 16B substitutes the target gradation tendency value of the first target value memory section 165 with the obtained target gradation tendency value (Step S11).

Next, the exposure time adjustment section 16*c* obtains the tolerance from the target value difference determination section 166, and reads the target gradation tendency value from the first target value memory section 165. Then the exposure time adjustment section 16C properly changes the exposure time data, with the precharge voltage data being fixed at a value.

Then the exposure time adjustment section 16C calculates the gradation tendency values, for each piece of exposure time data, from multi-gradation images obtained with the exposure time, and calculates the gradation tendency value differences between the respective calculated gradation tendency values and the target gradation tendency value. Then the exposure time adjustment section 16C specifies a minimum gradation tendency value difference out of the calculated gradation tendency value differences. The exposure time adjustment section 16C determines whether the specified gradation tendency value difference is more than the tolerance (Step S13).

When the specified gradation tendency value difference is not more than the tolerance, the control returns to Step S1.

On the other hand, when the specified gradation tendency value difference is more than the tolerance, the precharge voltage adjustment section 16D obtains the tolerance from the target value difference determination section 166, and reads the target gradation tendency value from the first target value memory section 165. Then the precharge voltage adjustment section 16D properly changes the precharge voltage data, with the exposure time data being fixed at the value already set.

Then the precharge voltage adjustment section 16D calculates the gradation tendency values, for each piece of precharge voltage data, from multi-gradation images obtained with the precharge voltage data, and calculates the gradation tendency value differences between the respective calculated gradation tendency values and the target gradation tendency value. Then the precharge voltage adjustment section 16D specifies a minimum gradation tendency value difference out of the calculated gradation tendency value differences. Then the precharge voltage adjustment section 16D determines whether the specified gradation tendency value difference is more than the tolerance (Step S15). Then the control returns to Step S1.

[Adjustment of Luminance of the Backlight and an Area Ratio of a Black Image in a Black and White Image]

Next, a description is given of adjustment of luminance of the backlight 17 and an area ratio of a black image in the black and white image.

The illuminance value calculation section 16E includes the following equation (2). For example, when a predetermined operation is performed, the illuminance value calculation section 16E substitutes the exposure time corresponding to the exposure time data and the precharge voltage corresponding to the precharge voltage data, which are set at that time, into the equation (2) to calculate an illuminance value corresponding to the illuminance of external light.

$$\text{Illuminance value} = c/(\text{Exposure time} \times \text{Precharge voltage}) \quad (2)$$

where c is a constant

Figure 10:
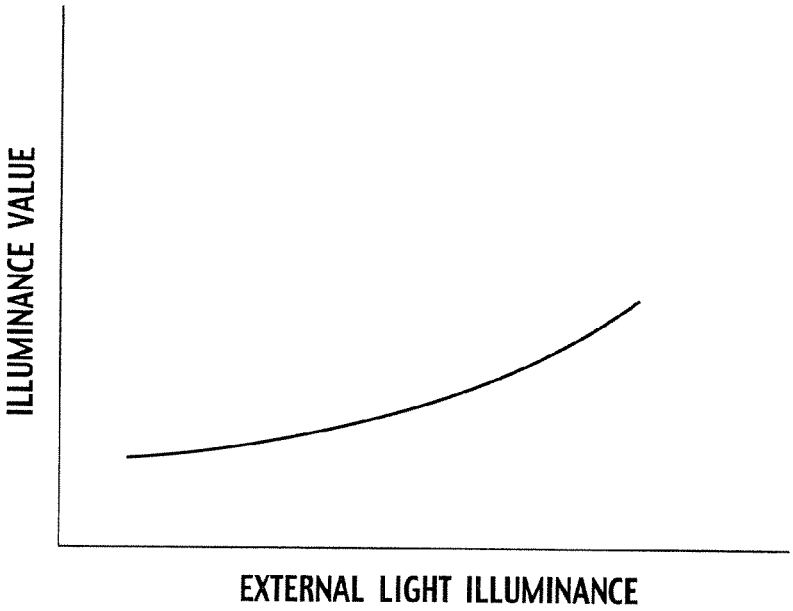
FIG. 10 is a graph showing a relation between the illuminance of external light and an illuminance value.

FIG. 10 is a graph showing a relation between the illuminance of external light and the illuminance value.

As shown in FIG. 10, the illuminance value calculated by the illuminance value calculation section 16E increases as the illuminance of external light increases.

Upon calculation of the illuminance value, when the calculated illuminance is more than the illuminance threshold value, the backlight adjustment section 16F adjusts the light intensity of the backlight 17 so that the luminance of the backlight 17 becomes the first luminance beforehand set. On the other hand, when the calculated illuminance value is not more than the illuminance threshold value, the backlight adjustment section 16F adjusts the light intensity of the backlight 17 so that the luminance of the backlight 17 becomes the second luminance beforehand set which is lower than the first luminance.

Figure 11:
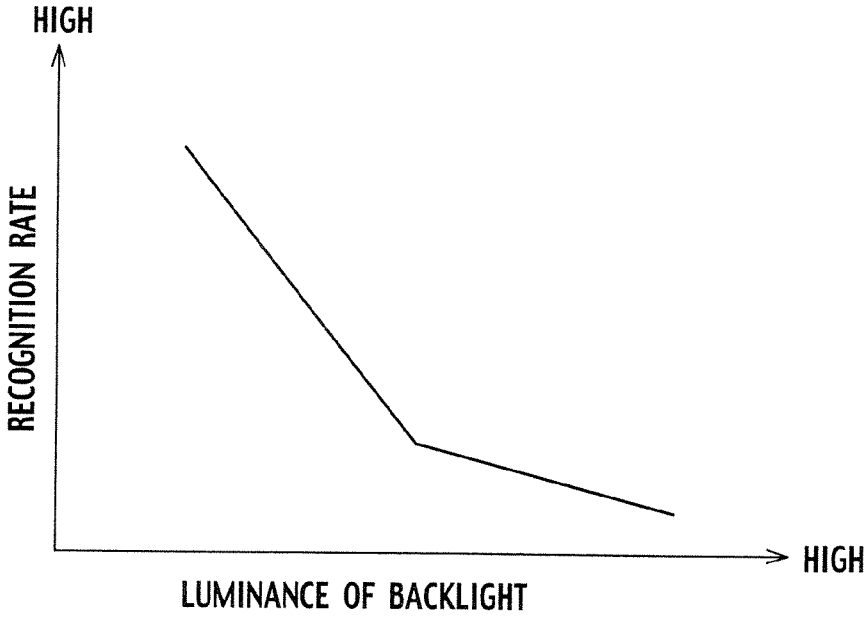
FIG. 11 is a graph showing a correlation in the low-illuminance range between a recognition rate and luminance of a backlight.

FIG. 11 is a graph showing a correlation in the low-illuminance range between the recognition rate and the luminance of the backlight 17.

As shown in FIG. 11, in the low-illuminance range, the recognition rate increases as the luminance of the backlight 17 decreases.

Accordingly, when the illuminance value is not more than the illuminance threshold value, the backlight adjustment section 16F reduces the luminance of the backlight 17, thereby the recognition rate can be increased and power consumption can be reduced.

After the calculation of the illuminance value, when the calculated illuminance value is more than the illuminance threshold value, the area ratio adjustment section 16G makes adjustments so that the area ratio of the black image in the black and white image of the display image stored in the recognized image memory section 162 becomes the first area ratio beforehand set. On the other hand, when the calculated illuminance value is not more than the illuminance threshold value, the area ratio adjustment section 16G makes adjustments so that the area ratio of the black image in the black and white image of the display image stored in the recognized image memory section 162 becomes the second area ratio which is higher than the first area ratio.

Figure 12:
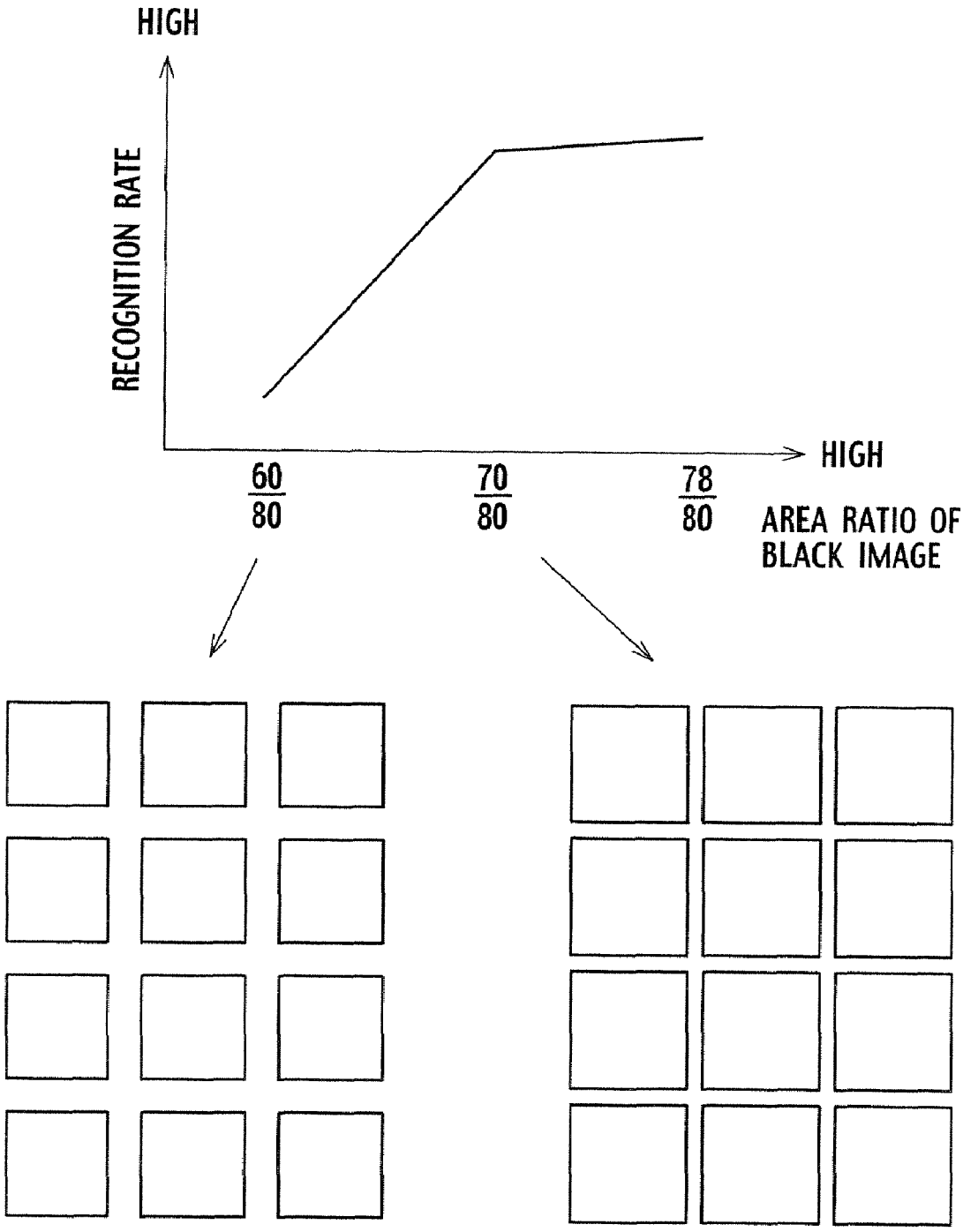
FIG. 12 is a view for explaining a relation in the low-illuminance range between the recognition rate and an area ratio of a black image to the black and white image.

FIG. 12 is a view explaining a relation in the low-illuminance range between the recognition rate and the area ratio of the black image in the black and white image.

As shown in FIG. 12, in the low-illuminance range, the recognition rate increases as the area ratio of the black image increases. The recognition rate increases because the edge area in the differential image can reduce the degree of phenomena of being obscured by light reflected on the finger.

Accordingly, when the illuminance value is not more than the illuminance threshold value, the area ratio adjustment section 16G increases the area ratio of the black image, thereby the recognition rate can be increased. Incidentally, when the area ratio of the black image is not less than 0.8, the recognition rate can be especially increased, and it is therefore preferable that the second area ratio is not less than 0.8.

Note that it is possible to automatically increase the recognition rate and reduce the power consumption by performing such a process when detecting that the recognition rate has decreased or the power consumption has increased.

As described above, in this embodiment, the gradient value correlating with the illuminance of external light is calculated (i.e., calculated is the ratio of a variation in the gradation tendency value in the multi-gradation image to a variation in the precharge voltage, with the exposure time being fixed). In this embodiment, it is therefore possible to prevent the reduction in performance, such as the reduction of the recognition rate or the increase in power consumption, due to variations in the illuminance of external light.

Note that, as the gradient value correlating with the illuminance of external light, it is allowed to use a ratio of a variation in the gradation tendency value of the multi-gradation image to a variation in the exposure time, with the precharge voltage being fixed.

In the case of this embodiment, the gradient value correlating with the illuminance of external light and ideal gradation tendency value is calculated, and the target gradation tendency value which can increase the recognition rate is calculated based on the calculated gradient value. The sensitivity of the optical sensor circuits is changed so as to obtain the calculated target gradation tendency value from the multi-gradation image, thereby making it possible to prevent the reduction in the recognition rate due to variations in the illuminance of external light.

In the case of this embodiment, the target gradation tendency value corresponding to the gradient value is calculated. This eliminates the need for a memory section beforehand storing the target gradation tendency value corresponding to each gradient value, thus enabling reduction of necessary storage capacity.

In the case of this embodiment, it is determined whether the gradation tendency value, at the time when the sensitivity of the optical sensor circuits are caused to be a predetermined sensitivity, is not less than the threshold value of the gradation tendency value (step S3). When the gradation tendency value is not less than the threshold value, the target gradation tendency value is read from the second target value memory section 16A (step S9). On the other hand, when the gradation tendency value is less than the threshold value, the target gradation tendency value is calculated by using the gradient value (step S7). Then the sensitivity of the optical sensor circuits are changed so that the read or calculated target gradation tendency value is obtained from the multi-gradation image (S13 and S15).

This can prevent the reduction in the recognition rate due to variations in the illuminance of external light. Moreover, when the gradation tendency value is less than the threshold value, the target gradation tendency value is obtained by calculation, thereby eliminating the need for a memory section beforehand storing the target gradation tendency value corresponding to each gradient value. On the other hand, when the target gradation tendency value is not less than the threshold value, the target gradation tendency value is read from the second target memory section 16A, thereby eliminating the need for the calculation.

By calculating the gradient value, which is the ratio of a variation in the gradation tendency value of the multi-gradation image to a variation in the precharge voltage with the exposure time being fixed, it is possible to prevent the reduction in performance due to variations in the illuminance of external light by using the gradient value.

The gradation tendency value difference is made not more than the tolerance, thereby making it possible to prevent the reduction in the recognition rate due to variations in the illuminance of external light.

The liquid crystal display apparatus includes the exposure time adjustment section 16C, which changes the exposure time with the precharge voltage being fixed, and the precharge voltage adjustment section 16D, which changes the precharge voltage with the exposure time being fixed. Accordingly, it is possible to prevent the reduction in the recognition rate by changing both the exposure time and the precharge voltage.

Note that only one of the exposure time adjustment section 16C and the precharge voltage adjustment section 16D may be provided to prevent the reduction in the recognition rate by changing the exposure time or the precharge voltage.

The backlight adjustment section 16F, which changes the luminance of the backlight 17 based on the gradient value, is provided, so that the recognition rate can be increased and the power consumption of the backlight 17 can be reduced, by reducing the luminance of the backlight 17 when the illuminance of external light is low.

The area ratio adjustment section 16G, which changes the area ratio of the black image in the black and white image based on the gradient value, is provided, so that the area ratio of the black image in the black and white image is increased when the illuminance of external light is low, thus making it possible to achieve a high recognition rate.

By setting the area ratio of the black image in the black and white image at 0.8 or more, it is possible to achieve a high recognition rate when the illuminance of external light is low.

Note that, in this embodiment, the sensitivity of the optical sensor circuits is changed based on the gradient value; the area ratio in the black and white image of black to white is changed based on the gradient value; and the luminance of the backlight 17 is changed based on the gradient value. However, at least one of these processes may be performed.

In this embodiment, the optical sensor circuit is provided for each pixel. However, the optical sensor circuits may be provided to some of the pixels, for example, pixels on every other line or every other row.

Second Embodiment

A liquid crystal display apparatus of this embodiment takes into consideration that an exposure characteristic of the optical sensor circuits S becomes unstable immediately after the sensitivity of the optical sensor circuits S is changed. Note that the exposure characteristic is how much photoelectric current is generated for predetermined incident light. The sensitivity of the optical sensor circuits S is changed by changing bias voltage such as precharge voltage, and by changing exposure time.

Figure 13:
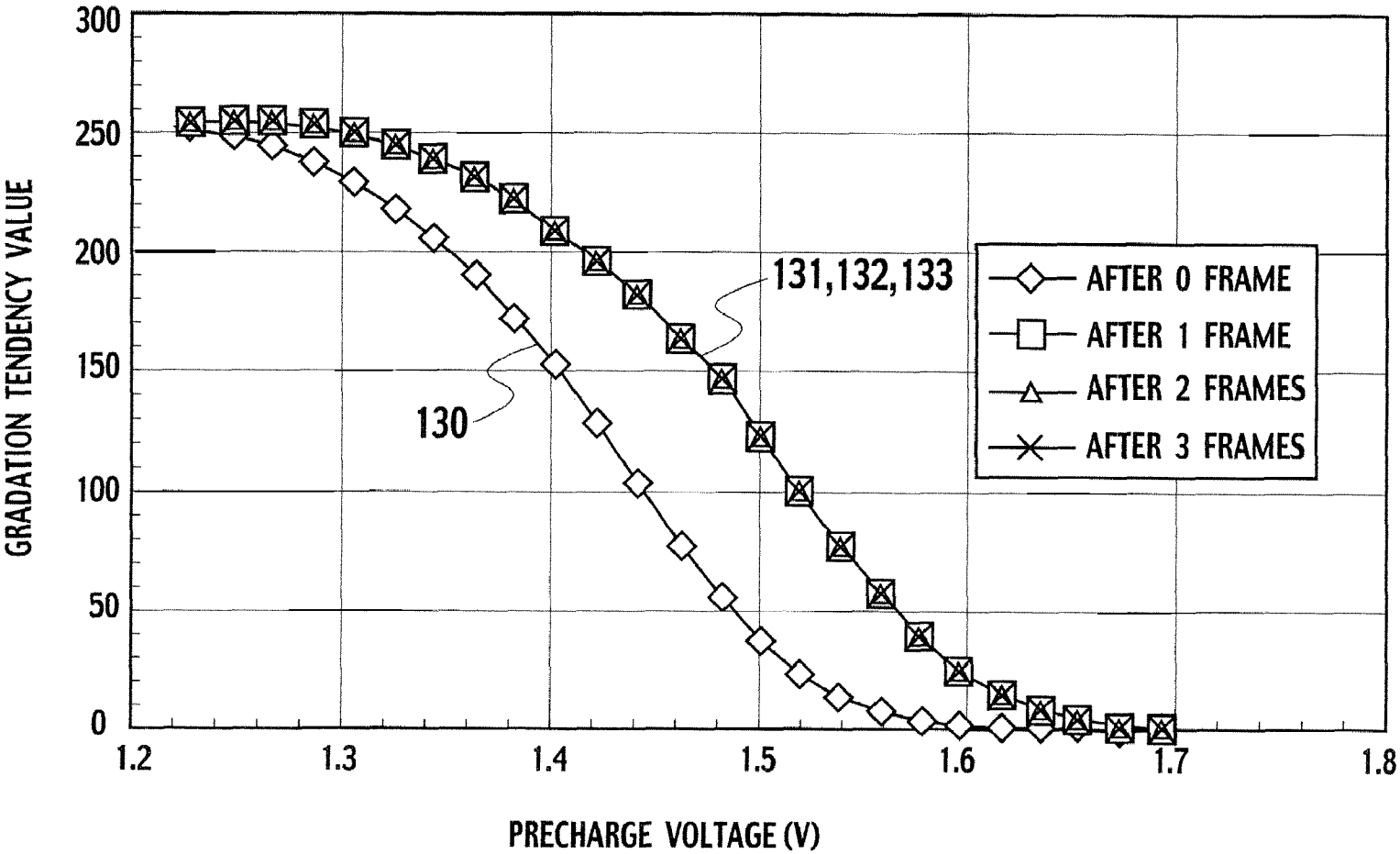
FIG. 13 is a graph for explaining an exposure characteristic of optical sensor circuits.

FIG. 13 is a graph specifically describing the exposure characteristic of the optical sensor circuits S.

The abscissa of FIG. 13 indicates the changed precharge voltage, and the ordinate thereof indicates the gradation tendency value. In the example shown in FIG. 13, the precharge voltage set at 4.5 V is changed to each precharge voltage, and the gradation tendency value corresponding to each of the changed precharge voltages is measured at a plurality of timing.

FIG. 13 shows a curve 130 of the gradation tendency value measured immediately after the change of the precharge voltage (after no frame period); a curve 131 of the gradation tendency value measured after one frame period has passed since the change of the precharge voltage; a curve 132 of the gradation tendency value measured after two frame periods have passed since the change of the precharge voltage; and a curve 133 of the gradation tendency value measured after three periods have passed since the change of the precharge voltage.

As shown in FIG. 13, the curve 130 immediately after the change of the precharge voltage and the curve 131 after one frame period has passed have a large difference. And the curve 131 after one frame period has passed and the curves 132 and 133 after the two frame periods and more have respectively passed have a small difference. The example of FIG. 13, therefore, shows that the exposure characteristic is stabilized after one frame period.

The liquid crystal display apparatus of the second embodiment is different from the liquid crystal display apparatus of the first embodiment in only some of the processes in the case where the sensitivity of the optical sensor circuits is changed, and the other parts are the same as those of the liquid crystal display apparatus of the first embodiment.

Next, the calibration related process of the second embodiment is described in comparison with the calibration related process of the first embodiment.

Figure 14:
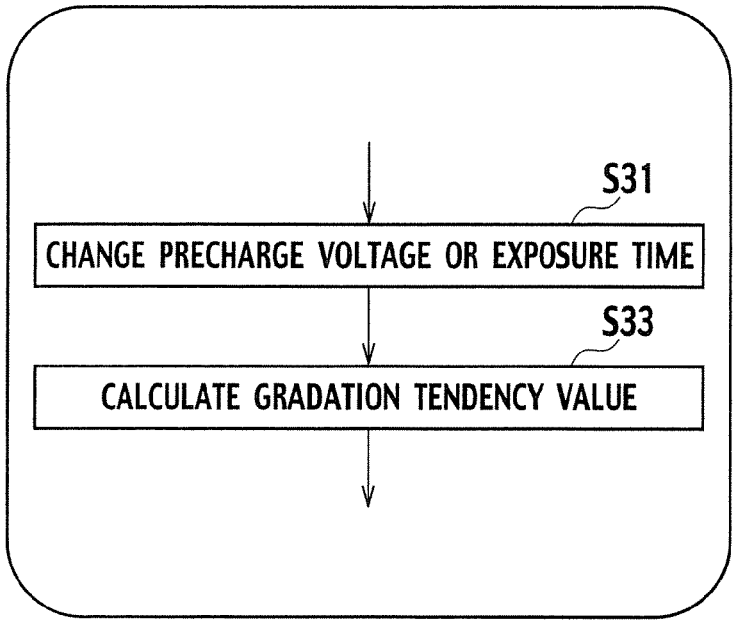
FIG. 14 is a flowchart of a part of the calibration related process of the first embodiment.

FIG. 14 is a flowchart of a part of the calibration related process in the first embodiment.

In the liquid crystal display apparatus of the first embodiment shown in FIG. 14, the precharge voltage or the exposure time of the optical sensor circuits S is changed (Step S31). Just after that, the detection result (a two-gradation image) of the optical sensor circuits S is converted into the multi-gradation image, and the gradation tendency value is calculated from the multi-gradation image (Step S33).

Note that the process of FIG. 14 is a part of Step S13 and S15 of FIG. 9, and the exposure time adjustment section 16C and the precharge voltage adjustment section 16D change the precharge voltage or the exposure time of the optical sensor circuits S, and immediately after that, calculates the gradation tendency value by using the multi-gradation image obtained by the imaging section 163.

And the process of FIG. 14 is a part of Step S5 of FIG. 9, and the gradient value calculation section 169 sets a precharge voltage and a exposure time, and just after that, calculates the gradation tendency value by using the multi-gradation image obtained by the imaging section 163.

Figure 15:
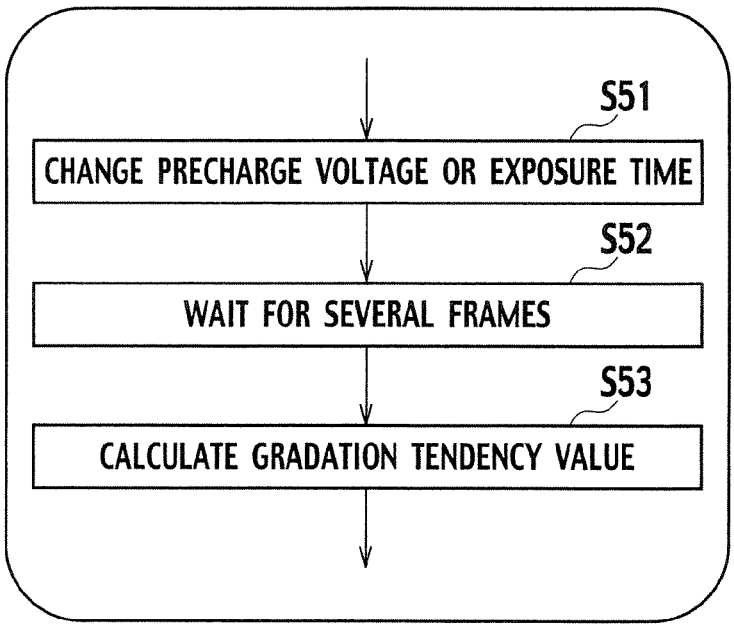
FIG. 15 is a flowchart of a part of a calibration related process of the second embodiment.

On the other hand, FIG. 15 is a flowchart of a part of the calibration related process in the second embodiment.

In the liquid crystal display of the second embodiment shown in FIG. 15, the precharge voltage or the exposure time of the optical sensor circuits is changed (Step S51), and then the process waits for a predetermined period of time (Step S52). After the predetermined period of time has passed, the detection result (a two-gradation image) of the optical sensor circuits S inputted from the detection circuit 14 is converted into the multi-gradation image, and the gradation tendency value is calculated (Step S53).

From the viewpoint of the operation stability of the optical sensor circuits S, it is preferable that the waiting time in Step S52 is longer. However, if the waiting time is longer, the calibration process requires more time. Accordingly, considering the measurement result of FIG. 13, it is preferable that the waiting time is about one frame period.

Note that the process of FIG. 15 is a part of Steps S13 and S15 of FIG. 9, and the exposure time adjustment section 16C and the precharge voltage adjustment sections 16D change the precharge voltage or the exposure time of the optical sensor circuits S. After the waiting time has passed since the change, the gradation tendency value is calculated by using the multi-gradation image obtained by the imaging section 163.

And the process of FIG. 15 is a part of Step S5 of FIG. 9, and the gradient value calculation section 169 sets a precharge voltage and a exposure time. After the waiting time has passed after the setting, the gradation tendency value is calculated by using the multi-gradation image obtained by the imaging section 163.

Note that, as the gradation tendency value of this embodiment, as in the case of the first embodiment, it is conceivable to use, for example, an average, a median, a value at the one third from the maximum value, and an integral value, of the multi-gradation values constituting the multi-gradation image.

In the liquid crystal display apparatus of this embodiment, after a waiting time has passed since the change of the sensitivity of the optical sensor circuits S, such as the change of the precharge voltage or the exposure time, the multi-gradation image is generated based on the detection result of the optical sensor circuits S, and then the gradation tendency value is calculated. It is therefore possible to prevent the calibration from being performed by using the multi-gradation image during the unstable period immediately after the sensitivity of the optical sensor circuits is changed. Accordingly, it is possible to prevent reduction in performance due to wrong calibration.

What is claimed is:

1. A liquid crystal display apparatus, comprising:

a pixel section including pixels arranged at each of intersections where a plurality of scanning lines and a plurality of signal lines intersect, and optical sensor circuits provided to at least part of the pixels;

an imaging section which generates a multi-gradation image based on detection results of the optical sensor circuits;

a recognition section which recognizes a recognition object on the pixel section based on the multi-gradation image;

a gradient value calculation section which calculates a gradient value which is a ratio of a variation in a gradation tendency value of the multi-gradation image to a variation in sensitivity of the optical sensor circuits;

a gradation tendency value calculation section which calculates, based on the gradient value, a target gradation tendency value for increasing a recognition rate of the recognition section; and a sensitivity adjustment section which changes the sensitivity of the optical sensor circuits so as to cause the multi-gradation image to have the calculated target gradation tendency value.

2. A liquid crystal display apparatus, comprising:

a pixel section including pixels arranged at each of intersections where a plurality of scanning lines and a plurality of signal lines intersect, and optical sensor circuits provided to at least part of the pixels;

an imaging section which generates a multi-gradation image based on detection results of the optical sensor circuits;

a recognition section which recognizes a recognition object on the pixel section based on the multi-gradation image;

a gradient value calculation section which calculates a gradient value which is a ratio of a variation in a gradation tendency value of the multi-gradation image to a variation in sensitivity of the optical sensor circuits;

a threshold value determination section which determines whether the gradation tendency value is not less than a threshold value when the sensitivity of the optical sensor circuits is caused to be a sensitivity;

a gradation tendency value calculation section which reads a beforehand stored target gradation tendency value when the gradation tendency value is not less than the threshold value, and which calculates, based on the gradient value, a target gradation tendency value for increasing a recognition rate of the recognition section when the gradation tendency value is less than the threshold value; and a sensitivity adjustment section which changes the sensitivity of the optical sensor circuits so as to cause the multi-gradation image to have the read or calculated target gradation tendency value.

3. The liquid crystal display apparatus according to any one of claims 1 and 2, wherein the gradient value calculation section calculates the gradient value when the gradient value correlates with illuminance of external light.

4. The liquid crystal display apparatus according to any one of claims 1 and 2, wherein in each of the optical sensor circuits, a capacitor is charged until inter-electrode voltage thereof reaches precharge voltage, and the inter-electrode voltage is binarized when exposure time has passed since start of discharge by a photoelectric conversion device, and the gradient value is a ratio of a variation in the gradation tendency value of the multi-gradation image to a variation in the precharge voltage, with the exposure time being fixed.

5. The liquid crystal display apparatus according to any one of claims 1 and 2, wherein the sensitivity adjustment section reduces a difference between the target gradation tendency value and the gradation tendency value obtained from the multi-gradation image to a difference not more than a tolerance.

6. The liquid crystal display apparatus according to any one of claims 1 and 2, wherein in each of the optical sensor circuits, a capacitor is charged until inter-electrode voltage thereof reaches precharge voltage, and the inter-electrode voltage is binarized when exposure time has passed since start of discharge by a photoelectric conversion device, and the sensitivity adjustment section includes at least one of:

an exposure time adjustment section which changes the exposure time with the precharge voltage being fixed; and a precharge voltage adjustment section which changes the precharge voltage with the exposure time being fixed.

7. The liquid crystal display apparatus according to any one of claims 1 and 2, further comprising:

a backlight provided on back of the pixel section;

a backlight adjustment section which changes luminance of the backlight based on the gradient value.

8. The liquid crystal display apparatus according to any one of claims 1 and 2, further comprising:

an area ratio adjustment section which changes an area ratio of a black image to a white image in a black and white image based on the gradient value, the area ratio being an index of the recognition object.

9. The liquid crystal display apparatus according to claim 8, wherein the area ratio adjustment section causes the area ratio of the black image in the black and white image to be not less than 0.8.

10. The liquid crystal display apparatus according to any one of claims 1 and 2, wherein the gradient value calculation section calculates the gradation tendency value of the multi-gradation image after a waiting time has passed since the change of the sensitivity of the optical sensor circuits, and calculates the gradient value using the calculated gradation tendency value.

11. The liquid crystal display apparatus according to claim 10, wherein the sensitivity of the optical sensor circuits is represented by any one of precharge voltage and exposure time.

12. The liquid crystal display apparatus according to claim 10, wherein the waiting time is one frame period.

13. The liquid crystal display apparatus according to any one of claims 1 and 2, wherein the sensitivity adjustment section calculates the gradation tendency value of the multi-gradation image after a waiting time has passed since the change of the sensitivity of the optical sensor circuits, and changes the sensitivity of the optical sensor circuits using the calculated gradation tendency value.

14. The liquid crystal display apparatus according to any one of claims 1 and 2, wherein the gradation tendency value is a median of the multi-gradation image generated by the imaging section.

* * * * *